US009227705B2

(12) United States Patent
Van Aken

(10) Patent No.: US 9,227,705 B2
(45) Date of Patent: Jan. 5, 2016

(54) STABILIZING FIN AND CONSTRUCTION COMPRISING SAID FIN

(71) Applicant: Arnoldus Henricus Maria Van Aken, Best (NL)

(72) Inventor: Arnoldus Henricus Maria Van Aken, Best (NL)

(73) Assignee: VAN AKEN GROUP B.V., Best (NL)

( * ) Notice: Subject to any disclaimer, the term of this patent is extended or adjusted under 35 U.S.C. 154(b) by 0 days.

(21) Appl. No.: 14/360,035

(22) PCT Filed: Nov. 19, 2012

(86) PCT No.: PCT/NL2012/050819

§ 371 (c)(1),
(2) Date: May 22, 2014

(87) PCT Pub. No.: WO2013/095097

PCT Pub. Date: Jun. 27, 2013

(65) Prior Publication Data

US 2014/0261134 A1 Sep. 18, 2014

(30) Foreign Application Priority Data

Nov. 23, 2011 (NL) ..... 2007844

(51) Int. Cl.
*B63B 39/06* (2006.01)

(52) U.S. Cl.
CPC ..... *B63B 39/06* (2013.01)

(58) Field of Classification Search
CPC ..... B63B 39/00; B63B 39/06
USPC ..... 114/126, 274, 280, 282
See application file for complete search history.

(56) References Cited

U.S. PATENT DOCUMENTS

| | | | | |
|---|---|---|---|---|
| 2,937,608 | A * | 5/1960 | Vandersteel | 114/126 |
| 2,942,570 | A * | 6/1960 | Kollenberger | B63B 39/06 114/126 |
| 3,687,100 | A * | 8/1972 | Larsh | 114/126 |
| 6,453,836 | B1 | 9/2002 | Ditmore | |
| 6,978,728 | B2 * | 12/2005 | Koop et al. | 114/126 |
| 2004/0011269 | A1 * | 1/2004 | Echenique Gordillo | 114/274 |

FOREIGN PATENT DOCUMENTS

| | | | |
|---|---|---|---|
| DE | 25 34 915 | A1 | 3/1976 |
| FR | 2 886 270 | A1 | 12/2006 |
| GB | 825 134 | A | 12/1959 |

OTHER PUBLICATIONS

International Search Report, dated Feb. 27, 2013, from corresponding PCT application.

* cited by examiner

*Primary Examiner* — Lars A Olson
(74) *Attorney, Agent, or Firm* — Young & Thompson

(57) ABSTRACT

An active stabilization device for stabilizing, for example, a vessel at sea, both in a first operating state in which the vessel moves and in a second operating state in which the vessel is in a rest position, includes at least one fin body (2) and a drive device which is connected to the fin body and is configured to drive the fin body. The device furthermore includes a hinge mechanism (5) which is connected to the fin body and is configured to position the fin body with respect to an outer side (1) of the construction by rotating the fin body about a first rotation axis 4 in such a manner that the fin body can generate a lifting force which can stabilize the construction at least in the second operating state. A vessel at sea which includes the device is also described.

16 Claims, 9 Drawing Sheets

STABILIZING FIN AND CONSTRUCTION COMPRISING SAID FIN

BACKGROUND OF THE INVENTION

Figure 1A:
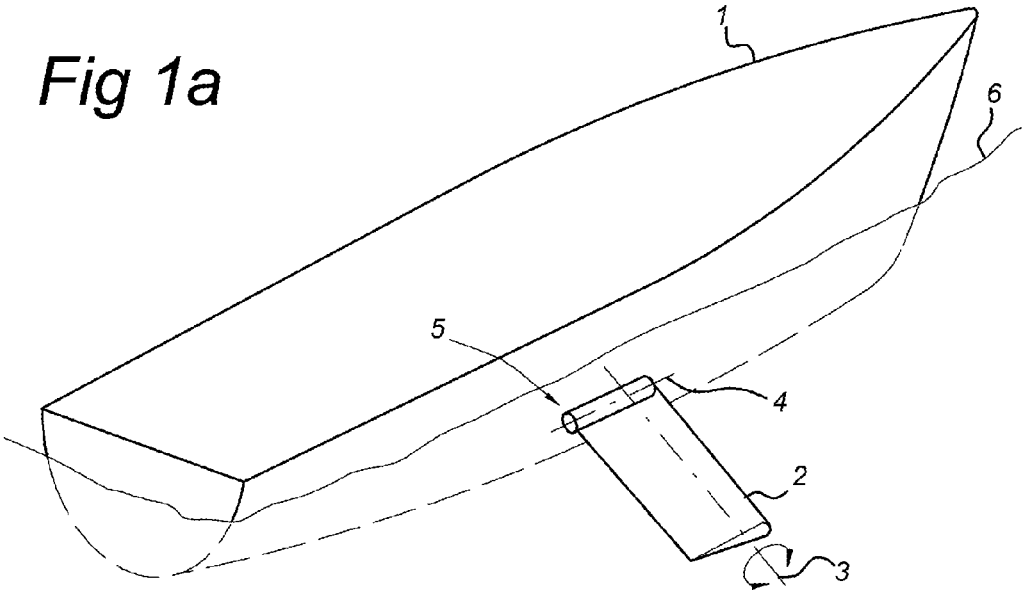

The invention relates to a device for actively stabilizing a construction which, in use, floats in a liquid, such as a vessel at sea, wherein the construction, in a first operating state, moves through the liquid and, in a second operating state, is in a rest position in the liquid, wherein the device comprises at least one fin body and a drive device which is connected to the fin body and is configured to drive the fin body.

The invention furthermore relates to a construction which, in use, floats in a liquid, such as a vessel at sea, wherein the construction comprises a device according to the present invention.

DESCRIPTION OF THE RELATED ART

Devices with fin bodies for actively stabilizing a construction which, in use, floats in a liquid while it is moving or stationary are known. As a result thereof, it is possible to improve the comfort of passengers on board. Such active stabilizing devices are used, for example, on luxury yachts in order to reduce the effects of wave motions of for example, sea water on the yacht. When the yacht is moving, stabilization is particularly important at speeds up to and including the cruising speed of the yacht. The cruising speed is the speed at which the yacht was designed to perform in an optimum manner in respect of, inter alia, fuel consumption, noise generation and stabilization. If a yacht travels at a higher speed than its cruising speed, active stabilization is no longer necessary or even desired in certain situations, due to the fact that stabilization increases quadratically with the sailing speed.

An operating state in which a construction, such as a yacht or a pontoon, moves in the liquid at a speed of at most the cruising speed, is referred to in the remainder of this patent application as a first operating state of the construction. The first operating state may also be referred to in the remainder of the present patent application as "underway" or "sailing". It will be clear to the person skilled in the art that where the application mentions "moving" of the construction, this includes sailing in all directions, that is to say forwards, backwards, sideways, etc.

As active stabilization is no longer necessary or even desirable in certain situations when a yacht travels at a speed greater than the cruising speed, it is advantageous if the fin bodies can be folded away in such a manner that they experience as little as possible resistance in the liquid ("drag"). In the case of known stabilization devices, the fin bodies are, for example, placed completely outside the flow of the water or the fin bodies are positioned behind the so-called hull of the ship. A minimal resistance ("drag") is advantageous so as not to increase the fuel consumption of the yacht unnecessarily during sailing.

Reducing the effects of wave motions of for example, sea water on a yacht is also important when the latter is floating on the water in a rest position, for example when it is anchored. In the remainder of the present patent application, such an operating state will be referred to as the second operating state of a construction floating in a liquid. The second operating state may also be referred to as "zero speed" or "stationary".

A first type of known active stabilization devices tries to achieve a reduced rolling motion of the yacht in the first operating state ("underway") by using fin bodies which are rotatable about a shaft which is transverse to an outer side of the yacht. In order to be of use for "underway" stabilization, it is important that the drag of the fin bodies is as low as possible. This can be achieved by fin bodies which extend further in a first direction which is substantially parallel to the direction of the shaft about which they can be rotated than in a second direction which is transverse to the first direction.

A drawback of these known fin bodies is that they are not particularly suitable for "zero speed" stabilization. Due to the fin shape, the distance between the shaft about which the fin bodies rotate and the central point of engagement of the forces which act on the fin body is relatively small. As a result thereof, the required moment which has to be supplied by the fin body to achieve "zero speed" stabilization is often too small.

The above-described fin bodies will be referred to as standard "underway" fin bodies in the remainder of the present patent application. As these fin bodies usually extend beyond the so-called block-like shape of the yacht, they have to be able to fold in so as to prevent the fins from being damaged due to becoming stuck in shallow water and/or due to manoeuvring in a harbour.

A second type of known active stabilization devices tries to improve the reduction of the rolling motion of the yacht in the second operating state ("zero speed") by reducing the fin balance which is determined by the ratio between the surfaces of a first and a second portion of the fin body which are situated opposite one another on either side of the shaft around which the fin body is rotatable. In the case of a standard "underway" fin body, the first portion is smaller than the second portion. The first portion is in this case situated on that side of the shaft which is oriented in the travelling direction in the first operating state of the yacht. The fin balance of such a fin body is usually approximately 25%. The fin balance can be reduced to, for example, 20% by displacing the shaft about which the fin body is rotatable in such a manner that the surface of the first portion becomes smaller and the surface of the second portion becomes larger. As a result thereof, the distance between the central point of engagement of the forces which act on the fin body and the shaft about which the fin body is rotatable is increased. Consequently, the fin body can supply a greater moment for stabilizing the yacht in the second operating state ("zero speed"). As a result, the reduction of the rolling motion of the yacht in the second operating state is improved compared to the reduction of the rolling motion of the yacht in the second operating state by the standard "underway" fin body. However, in practice, it is found that the moment supplied by fin bodies of known active stabilization devices of the second type is not sufficiently large to be able to achieve an effective reduction in the rolling motion in the second operating state.

A third type of known active stabilization devices tries to reduce the rolling motion of the yacht by using fin bodies which are rotatable about a shaft which is transverse to the outer side of the yacht. The length of these fin bodies in a first direction which runs substantially parallel to the direction of the shaft about which they are rotatable, usually stays within the block-like shape of the yacht. Compared to a standard "underway" fin body, the surfaces of the first and the second portion of the fin body are increased in such a manner that the fin balance remains unchanged, for example 20% or 25%. In particular due to the larger surface of the second portion of the fin body, the distance between the central point of engagement of the forces which act on this fin body and the shaft about which they are rotatable has become greater than in the case of the fin bodies of known active stabilization devices of the first and the second type. As a result thereof, a fin body of the third type of known active stabilization devices is able to supply a greater moment for the purpose of stabilizing the yacht in the "zero speed" operating state. A drawback of the fin body of the third type of known active stabilization devices is the fact that the stabilization in the "underway" operating state has become worse compared to the "underway" stabilization which can be achieved using the active stabilization devices of the first and the second type since the drag has increased.

A fourth type of known active stabilization devices attempts to reduce the rolling motion of the yacht by using fin bodies which are rotatable about a shaft which is transverse to an outer side of the yacht. Compared to known fin bodies, the fin surface of the above-described second portion of the fin body can be modified in a first direction which runs parallel to the direction of the shaft about which the fin body is rotatable and/or in a second direction which is transverse to the first direction.

By increasing the surface of the second portion of the fin body in the first and/or the second direction, the moment which has to be supplied in order to reduce the rolling motion of the yacht in the second operating state ("zero speed") can be increased. As a result thereof, an improved "zero speed" stabilization can be achieved. The surface of the second portion of the fin body can be increased by folding out or extending an additional fin body.

In the first operating state ("underway"), the additional fin body will preferably be folded in or retracted in order to keep the drag to a minimum.

With this known type of fin body, an effective reduction of the rolling motion of the yacht in "underway" situations as well as an improved reduction of the rolling motion of the yacht in "zero speed" situations can be achieved. The improved "zero speed" stabilization is limited by, in particular, the size of the additional fin body. Said size will often be limited due to the space which is available in the fin body for accommodating the additional fin body therein. A drawback of the fourth type of active stabilization device is the additional complexity of the fin body.

Active stabilization devices are also known which try to achieve a reduced rolling motion of the yacht in the "underway" and "zero speed" situations by using two different types of fin bodies. In this case, a first type of fin body is suitable for reducing the rolling motion of the yacht in the "underway" situation and a second type of fin body is suitable for reducing the rolling motion of the yacht in the "zero speed" situation. Although an optimum stabilization in each of the operating states of the yacht can be achieved, it is a drawback that two types of stabilization devices are in fact required for this purpose, a first type for stabilization in the first operating state of the yacht and a second type for stabilization in the second operating state.

SUMMARY OF THE INVENTION

It is an object of the present invention to provide a device for actively stabilizing a construction which, in use, floats in a liquid, for example a yacht at sea, wherein said device overcomes or at least reduces the abovementioned drawbacks of the known active stabilization devices.

It is also an object of the present invention to provide a construction which, in use, floats in a liquid, such as a yacht at sea or a pontoon, wherein the construction comprises a device according to the present invention.

At least one of these objects is achieved by a device according to the present invention, wherein the device furthermore comprises a hinge mechanism which is connected to the fin body and is configured to position the fin body with respect to an outer side of the construction by rotating the fin body about a first rotation axis in such a manner that the fin body can generate a lifting force which can stabilize the construction at least in the second operating state. Such a hinge mechanism makes it possible to achieve a significant improvement of the "zero speed" stabilization with the above-described known fin bodies. As a result of the rotation of the fin body about the first rotation axis, a kind of flapping movement can be produced in which the fin body moves up and down through the liquid in which the construction floats. In this case, the fin body is positioned in such a manner that the fin surface has a sufficiently large contact surface with the liquid to be displaced so that a lifting force which is required to significantly reduce the rolling motion of the construction in the second operating state ("zero speed") can be generated. In contrast with the above-described known active stabilization devices, it is therefore not necessary to increase the surface of the fin body in a direction which extends substantially parallel to the direction of the first rotation axis and/or in a direction transverse thereto in order to be able to supply the required lifting force. Thus, it is not necessary to use a fin body of complicated construction in the device according to the present invention.

By rotating the fin body about the first rotation axis, it is also possible to position the fin body in such a way with respect to the outer side of the construction that the rolling motion of the construction in the first operating state ("underway") can be reduced.

In an embodiment of the device according to the present invention, the hinge mechanism comprises a first shaft which is configured in such a way that the fin body, by rotation about the first shaft, can generate the lifting force which is required to stabilize the construction at least in the second operating state.

In an embodiment of the device according to the present invention, the first shaft comprises a plurality of shaft sections. These shaft sections can be moved collectively or independently from each other. On the one hand, it may be necessary to construct the first shaft from a plurality shaft sections if, for example, a single shaft section is not available in the desired dimensions for the fin body to be used and/or if a single shaft section cannot generate sufficient moment to supply the required lifting force for stabilizing the construction in the "zero speed" operating state. Also, if a single shaft section is not able to keep the fin body in its position due to the forces which act on the fin body in the first operating state ("underway"), it is also necessary to construct the first shaft from a plurality of shaft sections.

On the other hand, constructing the first shaft from a plurality of shaft sections may provide redundancy in case a drive for a certain shaft section fails. Consequently, failure of one or more shaft sections does not have to result in failure of the device according to the present invention, provided the remaining shaft sections can generate the required moment to provide the required lifting force in order to stabilize the construction in the "zero speed" operating state and to keep the fin body in its position in the "underway" operating state.

The use of a plurality of shaft sections or several groups of shaft sections furthermore makes it possible to move the fin body into a position with respect to the outer side of the construction in several steps. It is, for example, possible to set a first position of the fin body with respect to the outer side of the construction by means of a first group of shaft sections and to then use a second group of shaft sections to rotate the fin body in order to reduce the rolling motion of the construction in the second operating state ("zero speed").

In an embodiment of the device according to the present invention, the plurality of shaft sections can be moved independently from each other. This makes it possible to form different groups of shaft sections. If a first group of shaft sections and a second group of shaft sections has been formed, the first group may, for example, be used to rotate the fin body about the first shaft, while the second group is not in use. If the first group is no longer able to rotate the fin body about the first shaft, the second group can be employed. This provides redundancy and improves the operational reliability of the device according to the present invention.

In an embodiment of the device according to the present invention, the hinge mechanism is also configured to rotate the fin body about a second rotation axis which is directed transverse to the first rotation axis. Such a hinge mechanism thus makes it possible to further reduce the rolling motion of the construction, for example a yacht or a pontoon, in the first operating state ("underway") by rotating the fin body about the second rotation axis.

In contrast to the above-described known active stabilization devices, the device according to the present invention makes it possible, using a known standard "underway" fin body, to achieve improved stabilization in the second operating state ("zero speed") by rotation about the first rotation axis and improved stabilization in the first operating state ("underway") by rotation about the second rotation axis.

In an embodiment of the device according to the present invention, the hinge mechanism is configured to move the fin body, by means of a rotation about the first and/or about the second rotation axis, from an inactive position, in which at least one surface of the fin body is situated substantially parallel to and near the outer side of the construction, to an active position, in which the fin body is situated in such a manner with respect to the outer side of the construction that the construction is adapted to be stabilized in the first and/or in the second operating state by rotating the fin body about the first and/or about the second rotation axis. When the construction, for example a yacht, moves through the water at the cruising speed, stabilization is no longer necessary in certain cases and it is advantageous if at least one surface of the fin body can be positioned parallel to the outer side of the construction. Preferably, said surface is as large as possible. Thus, a drag of the yacht in the water can be achieved which is as low as possible and the fuel consumption of the yacht in this operating state can be limited. To this end, the fin body is positioned in the inactive position near the outer side of the yacht. From a functional point of view, the fin body is preferably positioned in such a way that it bears against the outer side of the yacht. This may, however, result in damage to the outer side of the yacht. In order to prevent this, it is possible to position the fin body near the outer side of the yacht. This means that there is a slight opening between the fin body and the outer side of the yacht.

In a direction transverse to the direction of the first rotation axis, the fin body comprises a first and a second end, wherein the first end is situated near the outer side of the yacht. The first rotation axis may be provided on the first end of the fin body, near the outer side of the yacht, but it is also possible for the first rotation axis to be positioned at a certain distance from the outer side of the construction, between the first and the second end of the fin body. This would make it possible for the fin body to comprise two parts, with a first part being positioned near the outer side of the yacht and a second part being rotatable about the first rotation axis. As a result thereof, the stabilization of the yacht in the "zero speed" operating state will be less effective than is the case if the first rotation axis is positioned closer to the first end of the fin body, near the outer side of the yacht. It is also conceivable for several rotation axes to be provided in the fin body which run parallel to the first rotation axis. Consideration may in this case be given to a first rotation axis which is positioned at the first end of the fin body and a further rotation axis which runs parallel to the first rotation axis which is positioned between the first and the second end of the fin body. It will be clear to the person skilled in the art that several embodiments are conceivable which fall within the scope of the present invention.

Furthermore, it has to be possible to move the fin body into the inactive position so as to prevent damage thereto as a result of becoming stuck in shallow water and/or when manoeuvring in a harbour.

In an embodiment of the device according to the present invention, the hinge mechanism also comprises a second shaft which is transverse to the first shaft, wherein the second shaft furthermore extends at a predetermined angle to the outer side of the construction and extends through the outer side of the construction, wherein the fin body is connected to the hinge mechanism in such a way that it is rotatable about the first and/or the second shaft. The predetermined angle at with the second shaft is positioned on the outer side of the yacht has a magnitude which is preferably in a range of 80-100 degrees and more preferably is approximately 90 degrees. However, it will be clear to the person skilled in the art that the magnitude of the angle does not necessarily have to be limited to the aforementioned range or the aforementioned value.

In this embodiment of the device according to the present invention, a hinge mechanism is provided which comprises at least two shafts about which the fin body which is connected thereto is rotatable in such a manner that the construction which is provided with the device according to the present invention can be stabilized, both in the "underway" and in the "zero speed" operating state. In the "underway" operating state, the rolling motion of the construction can be reduced by rotating the fin body about the second shaft which is transverse to the outer side of the construction. In the "zero speed" operating state, the fin body can be moved upwards and downwards from the "underway" position by rotation about the first shaft. As a result thereof, a lifting force can be generated which is sufficiently large to reduce the rolling motion in the "zero speed" operating state of the construction.

In an embodiment of the device according to the present invention, the hinge mechanism comprises a ball hinge which is configured to rotate the fin body about the first rotation axis and/or about a second rotation axis. As a result thereof, the construction of the hinge mechanism can be made simpler. The ball hinge also makes it possible to select another rotation axis in a simpler way.

In an embodiment of the device according to the present invention, the hinge mechanism is configured to position the fin body in a recess in the outer side of the construction. This makes it possible to accommodate the fin body in the recess in the outer side of the construction in such a flat manner that the fin body hardly protrudes beyond the outer side of the construction, if at all. During positioning of the fin body in the inactive position, the fin body does not pass through the outer side of the construction. This has the advantage that no valuable space is lost in a hold of the construction by accommodating the fin body in the construction.

In an embodiment of the device according to the present invention, the drive device comprises a unit for rotating the fin body about the first rotation axis, wherein the unit is accommodated substantially in the fin body. As a result thereof, no valuable space has to be sacrificed in an interior space of the construction. The unit in the fin body may be an electric-hydraulic powerpack which is connected to a power supply cable from the construction. It will be clear to the person skilled in the art that various implementations of the unit are conceivable which fall within the scope of the present invention.

In an embodiment of the device according to the present invention, the unit is connectable to a line from the construction, wherein the line is configured to supply power to the unit. This line may be an electrical or a pneumatic or a hydraulic line. In case of a hydraulic line, this line has to be provided with optionally automatic sealing elements in order to prevent the risk of environmental pollution as a result of damage to the hydraulic line. It will be clear to the person skilled in the art that various implementations are conceivable to connect the hydraulic line to the unit in the fin body which fall within the scope of the present invention.

In an embodiment of the device according to the present invention, the device comprises a first and a second fin body, which fin bodies are arranged on either side of the construction for stabilizing the construction in at least the second operating state by rotation about the first rotation axis. The first and the second fin body are preferably situated opposite each other on either side of the construction. It will be clear to the person skilled in the art that this is not strictly necessary for the operation of the device according to the present invention.

In an embodiment of the device according to the present invention, the device is configured in such a way that each fin body are movable simultaneously about both the first rotation axis and the second rotation axis. As a result thereof, a combined movement of the fin body can be effected. This combined movement of the fin body results in a force which can be used to displace the construction forwards or backwards in the liquid, even if the main drive of the construction is switched off. A combined movement of fin bodies which are fitted opposite one another on either side of the construction may for example be used to keep the stern of a yacht which is anchored off the coast directed towards the beach and to prevent the yacht from drifting off. Such a correction, which is known as "dynamic positioning" can prevent the yacht from changing position and drifting off due to currents, as a result of which, for example, the stern cannot be held in the desired position with respect to the beach.

The combined movement of fin bodies which are fitted on either side of the yacht can also be used to displace the yacht forwards or backwards or sideways in the water, for example when the main drive has failed as a result of a fault. Such a displacement is known as "trawling" and may be an advantageous option.

In an embodiment of the device according to the present invention, the device is configured in such a manner that fin bodies which are fitted on either side of the construction are movable asynchronously. When stabilizing the construction in the first operating state ("underway") and second operating state ("zero speed"), the fin bodies which are fitted on either side of the construction will be moved synchronously, that is to say simultaneously and in an identical manner. In the case of the above-described "dynamic positioning", however, the fin bodies have to be movable asynchronously. The drive device of the device according to the present invention will have to be adapted in such a manner that this is made possible. It will be clear to the person skilled in the art how such a modification of the drive device has to be carried out.

In an embodiment of the device according to the present invention, the fin body comprises a plurality of sections which are connected to each other by means of fastening elements so as to be movable. The fastening elements may extend in the direction of the first rotation axis and/or in the direction transverse thereto. As a result thereof, it is possible to give the fin body a shape such that the device according to the present invention can achieve a further improved stabilization of the construction, for example a yacht or a pontoon, in both the "underway" and "zero speed" operating states.

According to another aspect of the present invention, a construction is provided which, in use, floats in a liquid, such as a vessel at sea, in which the construction comprises a device according to the present invention.

Although the invention will be described with reference to specific embodiments, the invention is not limited to the illustrated embodiments. The invention is described by means of measures, in which case explicit advantages may be mentioned, but in which case there may also be implicit advantages. The subject matter of the invention of the present application or of a divisional application may relate to any of these measures, some combinations of which are described and/or illustrated explicitly in this description, but may also be described implicitly. Although the figures show explicit combinations of measures, it will be clear to the person skilled in the art that a number of the measures may also be taken separately.

BRIEF DESCRIPTION OF THE DRAWING FIGURES

FIG. 1A diagrammatically shows a perspective view of the hull of a yacht and a fin body according to an embodiment of the device according to the present invention, wherein the yacht is in a first operating state ("underway") and the fin body is in an active position.

Figure 1B:
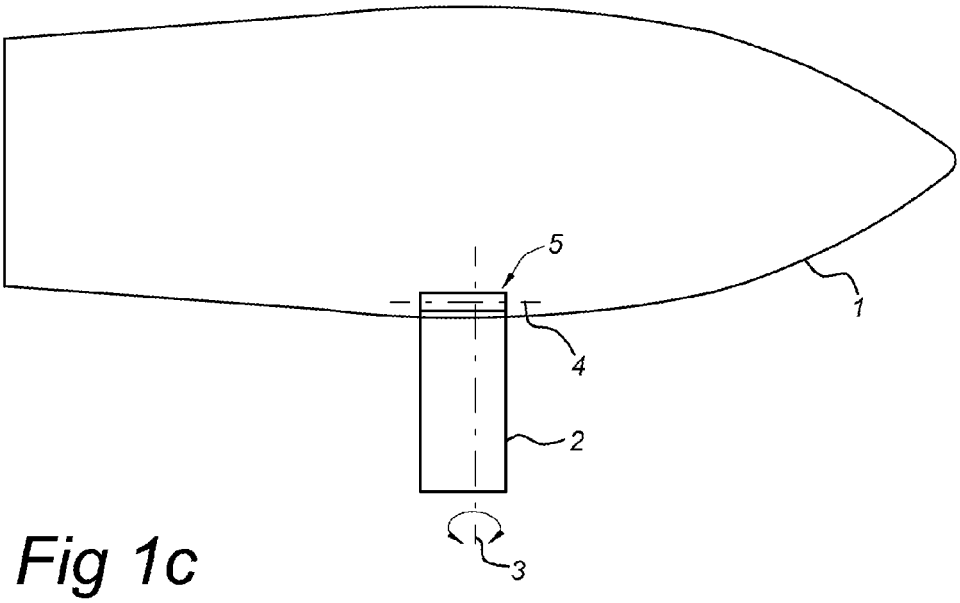

FIG. 1B diagrammatically shows a top view of the hull of the yacht and the fin body from FIG. 1A.

Figure 1C:
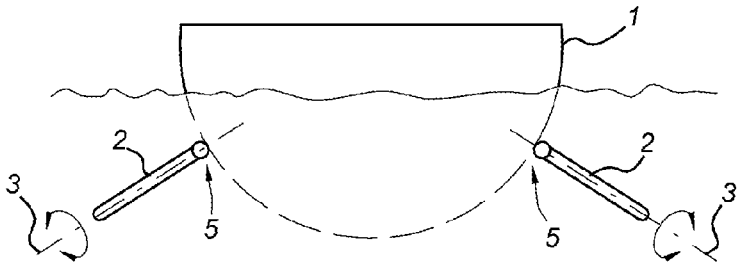

FIG. 1C diagrammatically shows a rear view of the hull of the yacht and the fin body from FIG. 1A.

Figure 2A:
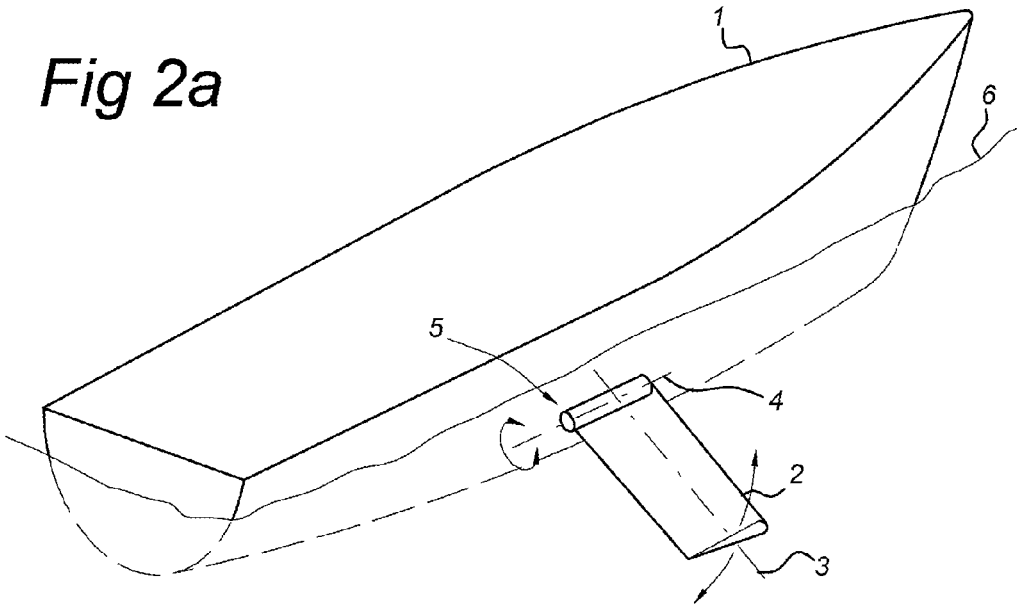

FIG. 2A diagrammatically shows a perspective view of the hull of the yacht and the fin body according to an embodiment of the device according to the present invention, wherein the yacht is in a second operating state ("zero speed") and the fin body is in the active position.

Figure 2B:
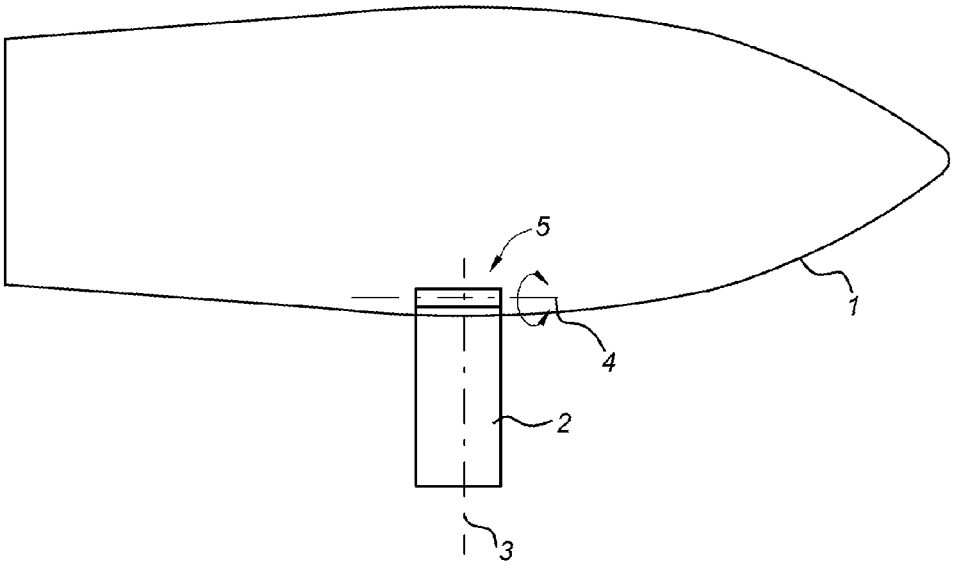

FIG. 2B diagrammatically shows a top view of the hull of the yacht and the fin body from FIG. 2A.

Figure 2C:
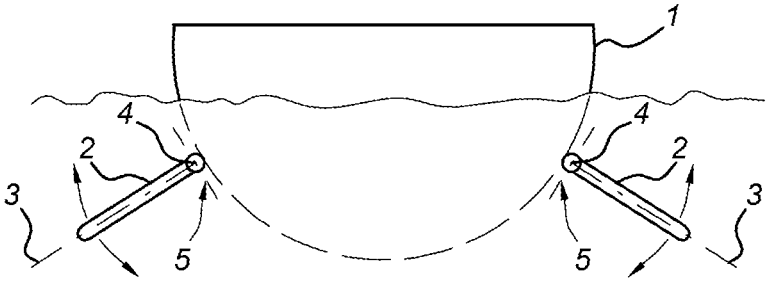

FIG. 2C diagrammatically shows a rear view of the hull of the yacht and the fin body from FIG. 2A.

Figure 2D:
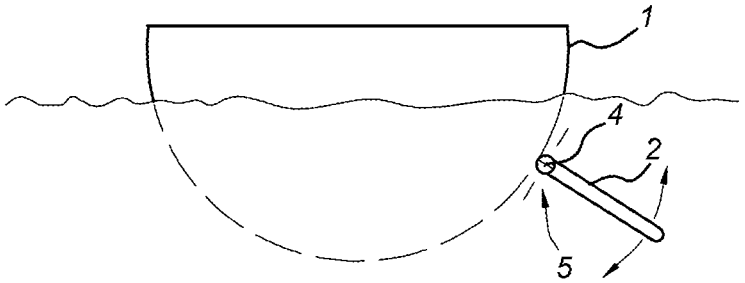

FIG. 2D diagrammatically shows a rear view of the hull of the yacht and a single fin body as shown in FIG. 2A according to an embodiment of the device according to the present invention.

Figure 3A:
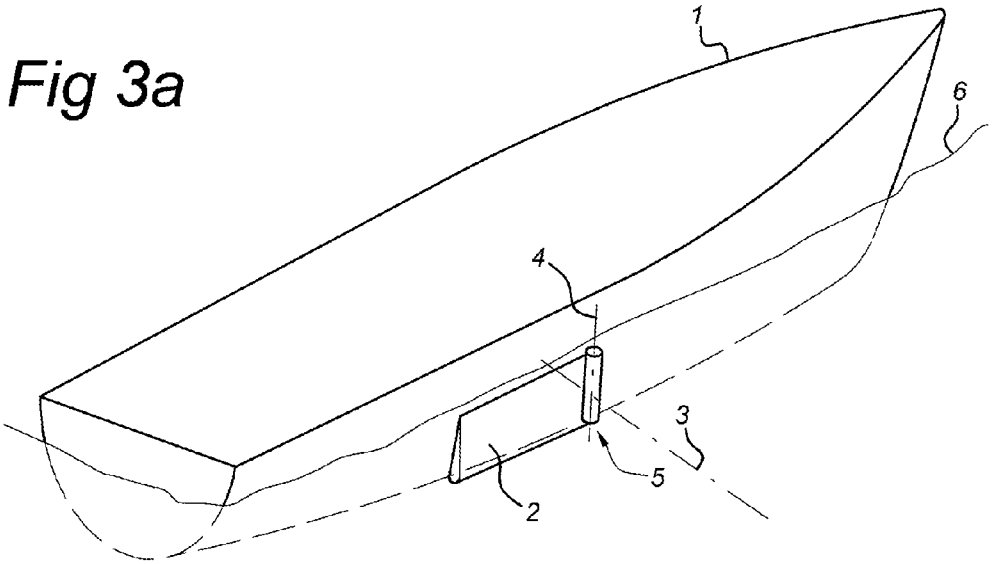

FIG. 3A diagrammatically shows a perspective view of the hull of the yacht and the fin body according to an embodiment of the device according to the present invention, wherein the fin body is in an inactive position.

Figure 3B:
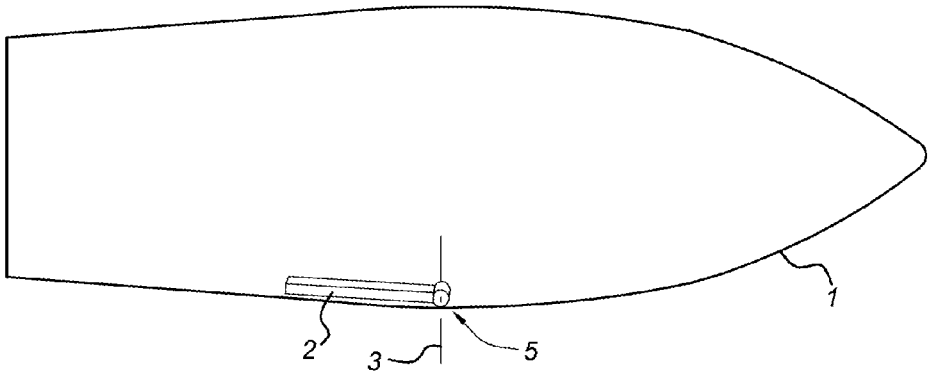

FIG. 3B diagrammatically shows a top view of the hull of the yacht and the fin body from FIG. 3A.

Figure 3C:
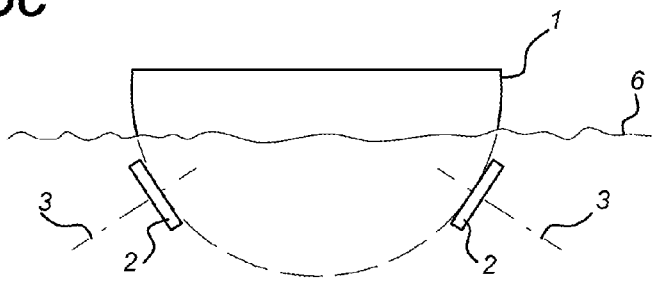

FIG. 3C diagrammatically shows a rear view of the hull of the yacht and the fin body from FIG. 3A.

Figure 4A:
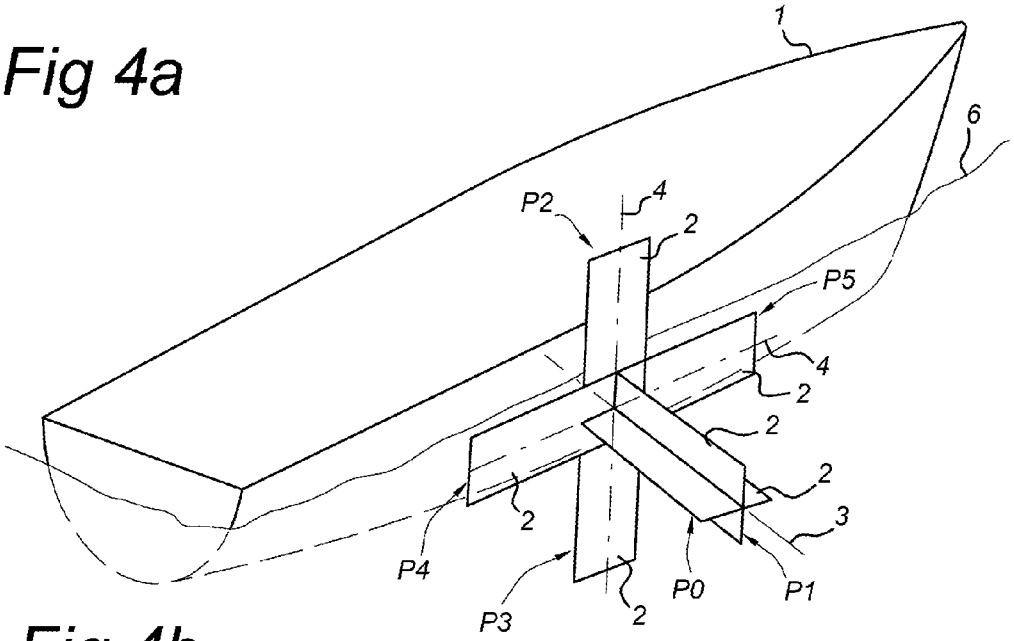

FIG. 4A diagrammatically shows a perspective view of the hull of the yacht and the fin body according to an embodiment of the device according to the present invention, wherein various possible positions of the fin body are illustrated.

Figure 4B:
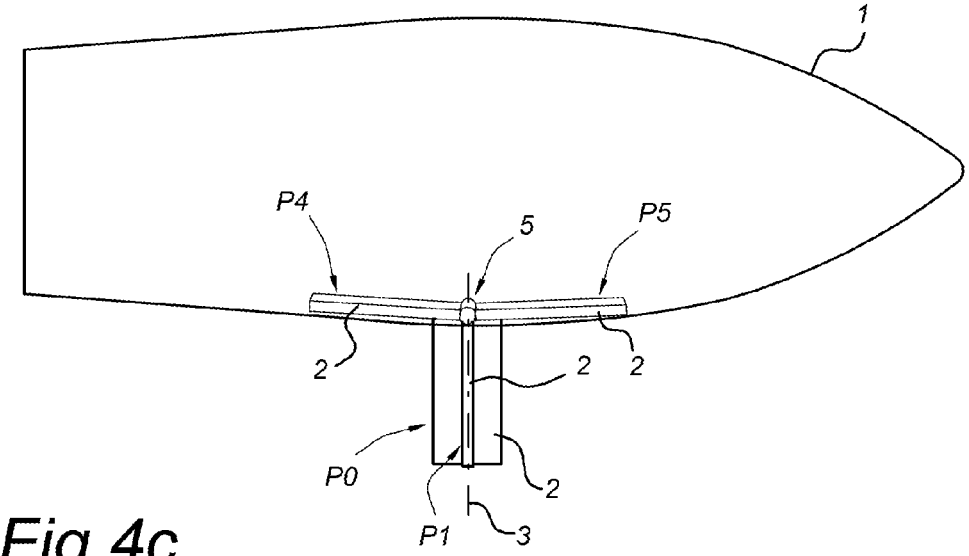

FIG. 4B diagrammatically shows a top view of the hull of the yacht and the fin body in various possible positions according to FIG. 4A.

Figure 4C:
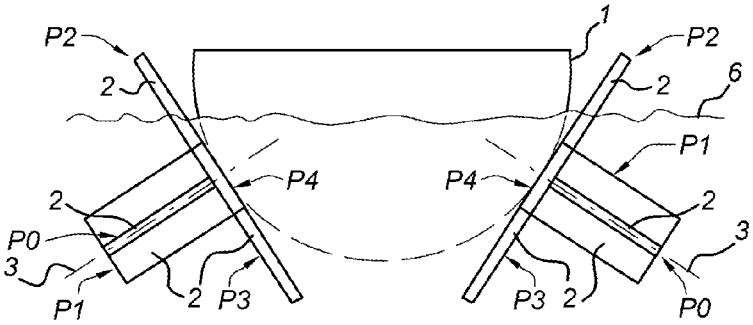

FIG. 4C diagrammatically shows a rear view of the hull of the yacht and the fin body in various possible positions according to FIG. 4A.

Figure 5A:
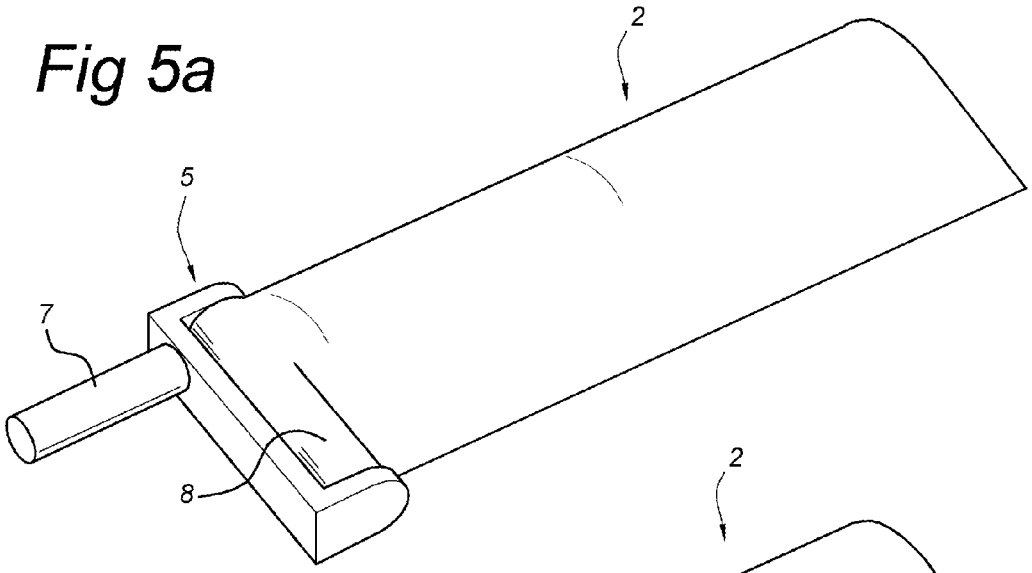

FIG. 5A diagrammatically shows a perspective view of a first embodiment of a hinge mechanism and a first embodiment of a fin body according to the present invention.

Figure 5B:
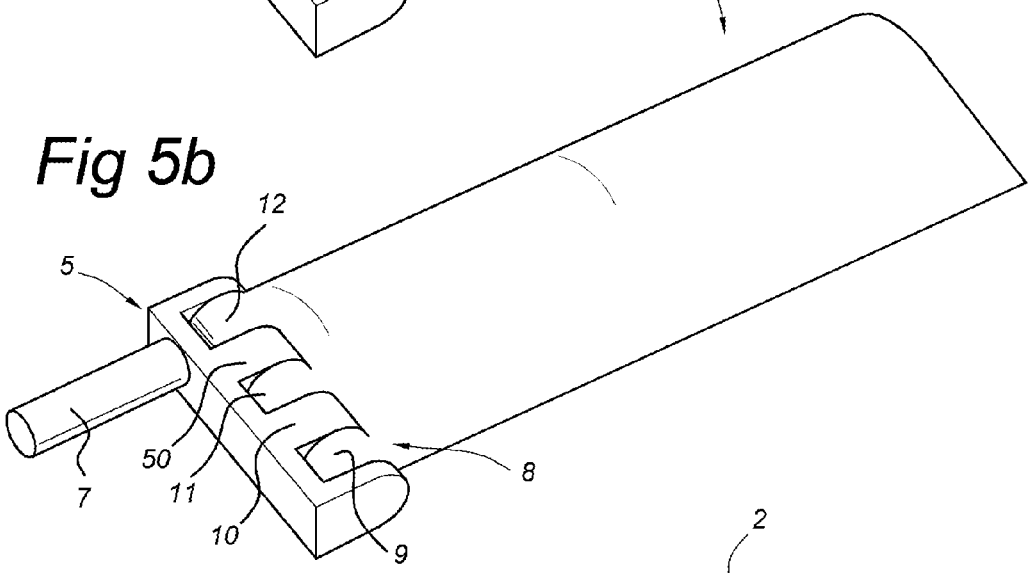

FIG. 5B diagrammatically shows a perspective view of a second embodiment of the hinge mechanism according to the present invention which is connected to the fin body from FIG. 5A.

Figure 5C:
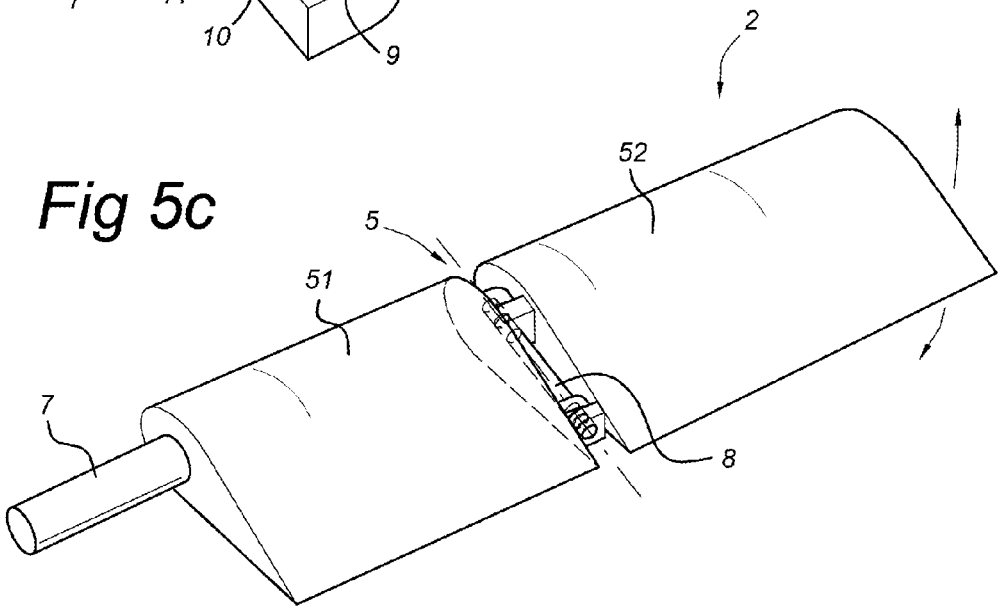

FIG. 5C diagrammatically shows a perspective view of a third embodiment of the hinge mechanism according to the present invention which is connected to a second embodiment of a fin body.

Figure 5D:
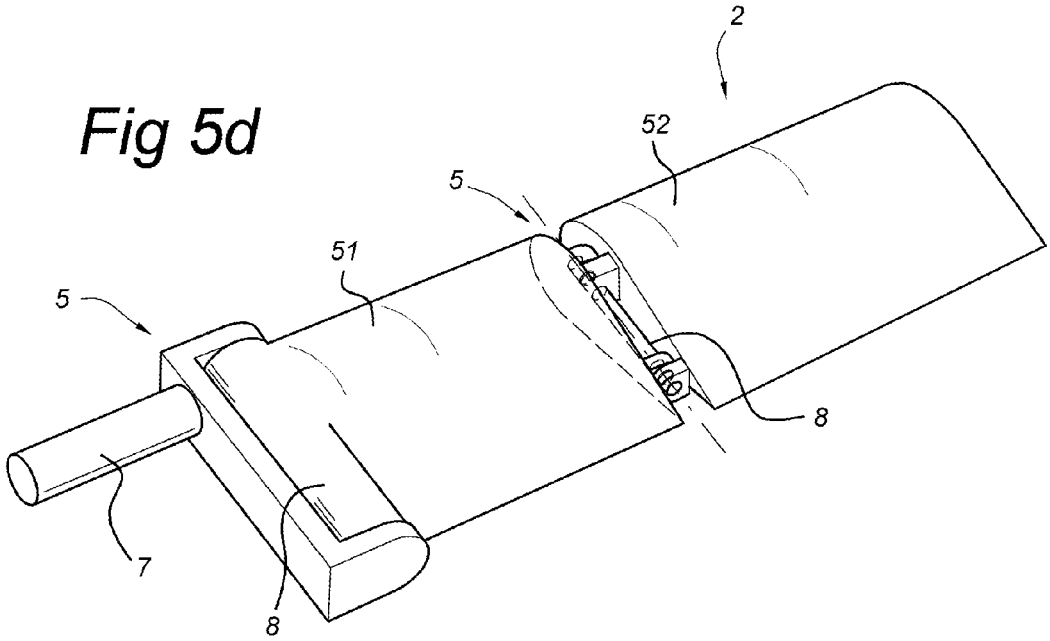

FIG. 5D diagrammatically shows a perspective view of a combination of the two hinge mechanisms and a fin body according to FIGS. 5A and 5C, respectively.

Figure 5E:
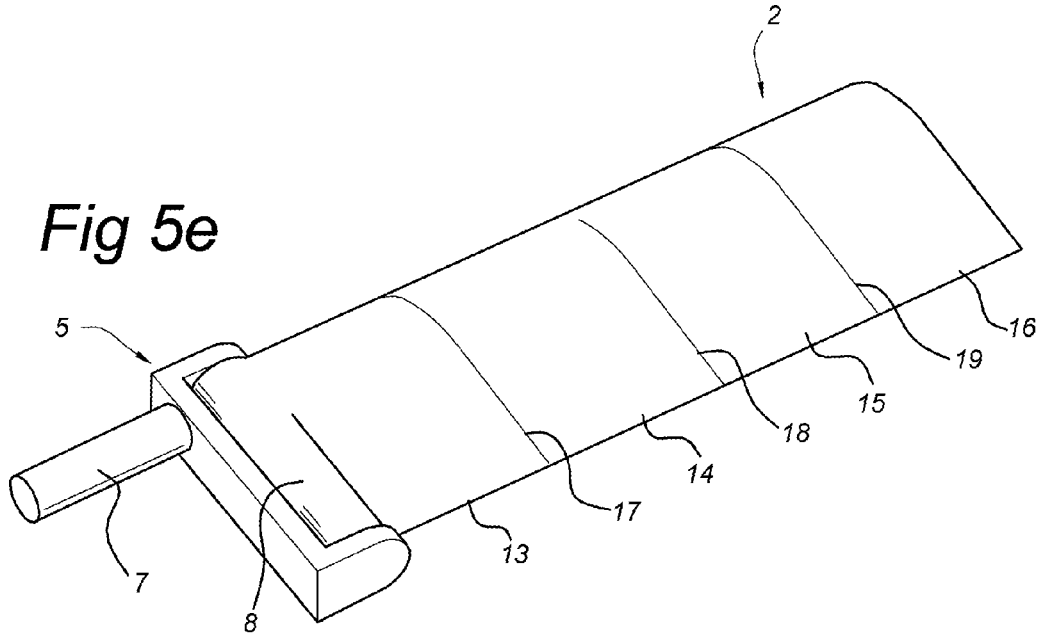

FIG. 5E diagrammatically shows a perspective view of a third embodiment of the fin body according to the present invention which is connected to a hinge mechanism from FIG. 5A.

Figure 5F:
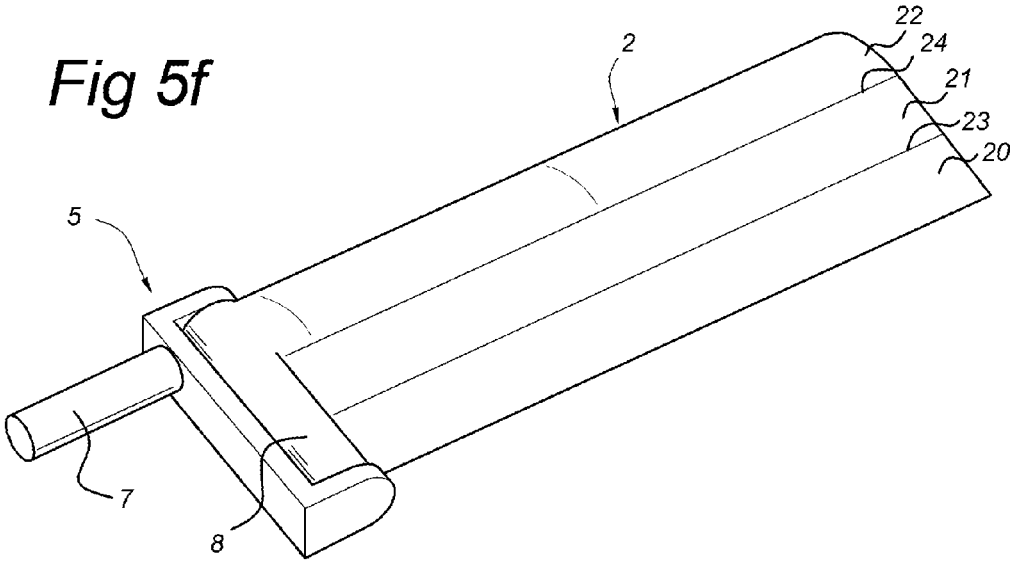

FIG. 5F diagrammatically shows a perspective view of a fourth embodiment of the fin body according to the present invention which is connected to a hinge mechanism from FIG. 5A.

Figure 5G:
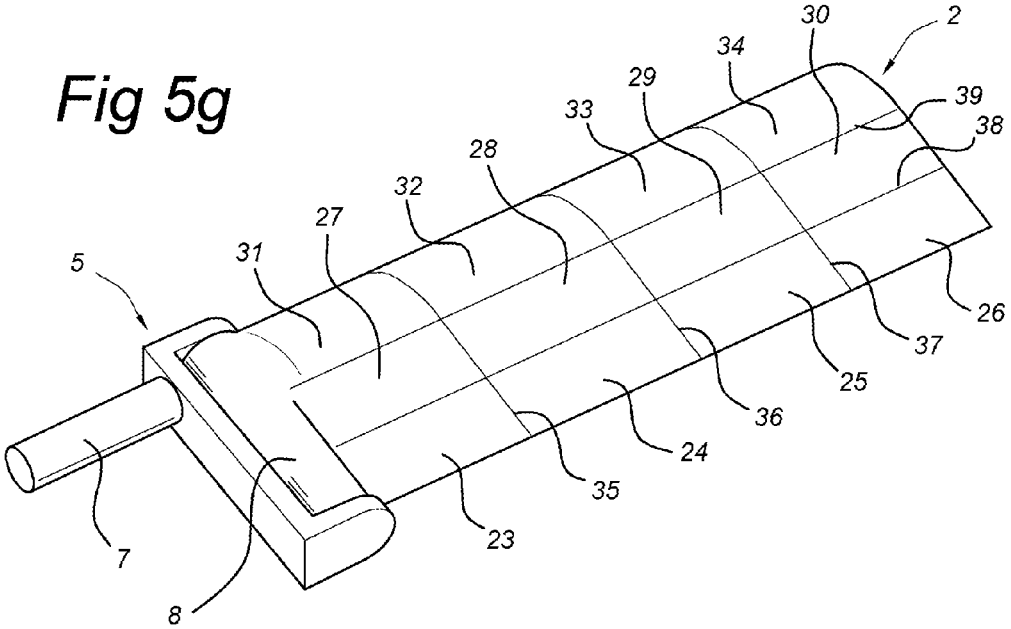

FIG. 5G diagrammatically shows a perspective view of a fifth embodiment of the fin body according to the present invention which is connected to a hinge mechanism from FIG. 5A.

Figure 6:
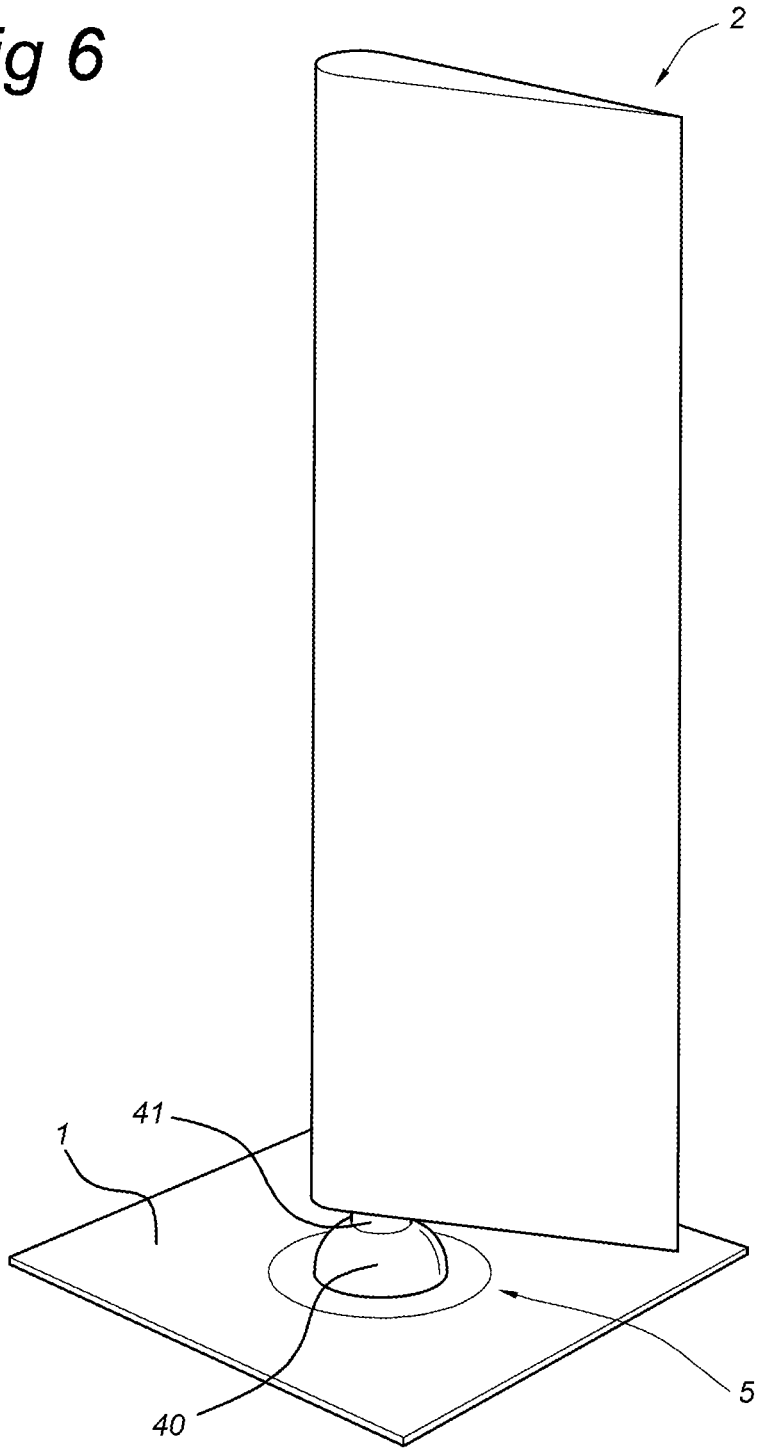

FIG. 6 shows a third embodiment of the hinge mechanism according to the present invention which is connected to a fin body according to the first embodiment as shown, inter alia, in FIG. 5A.

DETAILED DESCRIPTION OF THE INVENTION

The figures are not necessarily drawn to scale. Identical or similar parts in the various figures may be denoted by the same reference numbers.

FIG. 1A diagrammatically shows a perspective view of the hull 1 of a yacht and a fin body 2 according to an embodiment of the device according to the present invention, wherein the yacht is in a first operating state ("underway") and the fin body 2 is in an active position below the water level 6. The device furthermore comprises a drive device which is not illustrated in FIGS. 1A-1C and which is connected to each fin body 2 and is configured to drive the fin bodies 2 in such a manner that they can stabilize the yacht both in a first operating state ("underway") and in the second operating state ("zero speed"). In this case, the drive device may be substantially situated in a hold of the yacht. As is described above, it is also possible for a unit of the drive device to be accommodated substantially in the fin body 2.

The device furthermore comprises a hinge mechanism 5 which is configured to position each fin body 2 with respect to the hull 1 of the yacht by rotating each fin body 2 about a first rotation axis 4 and/or about a second rotation axis 3 which is directed transverse to the first rotation axis 4. In the active position of the fin body 2, as illustrated in FIGS. 1A-1C, the device according to the present invention can reduce the rolling motion of the yacht by rotating the fin body 2 about the second rotation axis 3 which, in this embodiment of the device according to the present invention, is directed transverse to the hull 1 of the yacht.

As has been described above, the device may comprise one fin body 2 for stabilizing the rolling motion both in the first and in the second operating state. This is only shown in FIG. 2D, because in FIGS. 2A-2D the stabilization of the yacht in the second operating state ("zero speed") is explained in more detail.

FIG. 1B diagrammatically shows a top view of the hull 1 of the yacht and the fin body 2 from FIG. 1A. It can be seen in FIG. 1B that the fin body 2 extends further in the direction of the second rotation axis 3 than in a direction transverse thereto. As a result thereof, a fin body 2 is provided which has a drag which is as low as possible during "underway" stabilization. This is advantageous as it prevents unnecessary consumption of fuel in this operating state of the yacht.

FIG. 1C diagrammatically shows a rear view of the hull 1 of the yacht and the fin body 2 from FIG. 1A. FIG. 1C shows the position of the two fin bodies 2 which are illustrated as a non-limiting example and which are fitted opposite each other on either side of the hull 1 of the yacht in order to reduce the rolling motion of the yacht in the first operating state ("underway"). It will be clear to the person skilled in the art that, depending on, for example, the length of the yacht or other requirements regarding the stabilization of the yacht, it is also possible to use, for example, one, four, five or six fin bodies.

FIG. 2A diagrammatically shows a perspective view of the hull 1 of the yacht and the fin body 2 according to an embodiment of the device according to the present invention, wherein the yacht is in a second operating state ("zero speed"). The fin body 2 is in the active position. As is illustrated in FIGS. 2A-2D, the device according to the present invention may reduce the rolling motion of the yacht in the second operating state ("zero speed") by rotating the fin body 2 about the first rotation axis 4 which is transverse to the second rotation axis 3. As a result thereof, the fin bodies 2 can execute a kind of flapping movement, in which the fin bodies 2 move upwards and downwards in the water. As a result thereof, a lifting force can be generated which is sufficient to stabilize the yacht in "zero speed", for example when it is anchored. Due to the stabilization, the comfort of passengers is improved.

FIG. 2B diagrammatically shows a top view of the hull 1 of the yacht and the fin body 2 from FIG. 2A. As can be seen in FIG. 2B, the fin body 2, in contrast with the above-described known stabilization devices, has the same shape as in the first operating state ("underway") of the yacht. A reduction of the rolling motion of the yacht can be achieved in the second operating state ("zero speed") by rotating the fin body 2 about the first rotation axis 4.

FIG. 2C diagrammatically shows a rear view of the hull 1 of the yacht and the fin body 2 from FIG. 2A. FIG. 2C shows the position of the fin bodies 2 which are fitted opposite one another on either side of the hull 1 of the yacht in order to reduce the rolling motion of the yacht in the second operating state ("zero speed"). This figure furthermore illustrates the flapping movement performed by the fin bodies 2 due to the rotation about the first rotation axis 4.

FIG. 2D diagrammatically shows a rear view of the hull of the yacht and a single fin body 2 as illustrated in FIG. 2A according to an embodiment of the device according to the present invention. As described above, one single fin body 2 is sufficient to stabilize the yacht, both in the first and in the second operating state. Stabilization of the yacht in the second operating state can be achieved by rotating the fin body 2 about the first rotation axis 4.

FIG. 3A diagrammatically shows a perspective view of the hull 1 of the yacht and the fin body 2 according to an embodiment of the device according to the present invention, wherein the fin body 2 is in an inactive position. As can be seen in FIG. 3C, according to this embodiment of the fin body 2, the entire fin surface runs parallel to and bears against the hull 1 of the yacht. In order to prevent damage to the hull 1 of the yacht, the entire fin surface can be arranged at a small distance from and parallel to the hull 1 of the yacht.

According to another embodiment of the device according to the present invention, the fin body 2 can be accommodated in a recess (not shown) in the hull 1 of the yacht when the fin body 2 is moved from the active to the inactive position. As a result thereof, it is possible to accommodate the fin body 2 in such a flat manner in the recess in the hull 1 of the yacht that the fin body 2 hardly protrudes beyond the outer side of the hull 1, if at all. During positioning of the fin body 2 in the inactive position, the fin body 2 does not pass through the hull 1 of the yacht. This has the advantage that no valuable space is lost in a hold of the yacht by accommodating the fin body 2 in the yacht.

According to a further embodiment (not shown) of the fin body 2, at least a portion of the fin surface can be positioned parallel to and near the hull 1 of the yacht. Preferably, this portion is as large as possible so that the opening between the hull 1 and the fin surface which is arranged parallel to the hull 1 can be as small as possible.

FIG. 3B diagrammatically shows a top view of the hull 1 of the yacht and the fin body 2 from FIG. 3A which is in an inactive position. It should be noted in this case that the illustrated position of the fin body 2 is an example and that other positions of the fin body 2 are conceivable in which the fin body 2 is in an inactive position.

FIG. 4A diagrammatically shows a perspective view of the hull 1 of the yacht and the fin body 2 according to an embodiment of the device according to the present invention, in which various possible positions of the fin body 2 are shown. It will be clear to the person skilled in the art that several positions of the fin body are possible which fall within the scope of protection of the present patent application.

Position P0 is a position which the fin body 2 substantially assumes during stabilization in the first operating state ("underway"). Position P1 is a position which the fin body 2 may assume by rotation about the second rotation axis 3 in preparation of the move of the fin body 2 from the active position P0 to the inactive positions P4 or P5. From position P1, the fin body 2 can be moved to the inactive positions P4 or P5 by rotation about the first rotation axis 4 which is in this case directed transverse to the water level 6. Moving the fin body 2 from position P0 to position P4 or P5 via position P1 in this way is possible if the yacht is in the second operating state ("zero speed") or if the yacht travels at low speed, the so-called "trawling", for example due to the combined movement of the fin bodies 2 which are arranged on either side of the hull 1, as has already been described above. The reason for this is that the fin body 2 in position P1 is rotated so that it is transverse to a possible travelling direction of the yacht. At excessive sailing speeds, the forces acting on the fin body 2 in this case would become unacceptably large. This could damage the fin body 2 and consequently the device according to the present invention.

Positions P2 and P3 could be inactive positions for the fin body 2, in particular in the case of a hinge mechanism 5 which is configured in such a manner that only rotation about the first rotation axis 4 is possible. The fin body 2 can be moved from position P0 to position P2 or P3 by rotation about the first rotation axis 4 which is in this case directed parallel to the water level 6. If the hinge mechanism 5 is configured such that the fin body can also rotate about the second rotation axis 3, positions P2 and P3 are preferably positions which the fin body 2 can assume in preparation of moving the fin body 2 from the active position P0 to inactive positions P4 and P5. From P2 and P3, the fin body 2 can be moved into the inactive position P4 or P5 by rotation about the second rotation axis 3. Moving the fin body 2 into inactive positions P4 or P5 via positions P2 or P3 is possible in any operating state of the yacht, that is to say at all travelling speeds.

FIG. 4B diagrammatically shows a top view of the hull 1 of the yacht and the fin body 2 in various possible positions in both the active and the inactive position. FIG. 4C diagrammatically shows a rear view of the hull 1 of the yacht and the fin body 2 in various possible positions in both the active and the inactive position.

FIG. 5A diagrammatically shows a perspective view of a first embodiment of both a hinge mechanism 5 and a fin body 2 according to the present invention. The hinge mechanism 5 comprises a first shaft 8 and a second shaft 7. The second shaft 7 can be positioned at a predetermined angle to the hull 1 of the yacht and, in use, extends through the hull 1 of the yacht. The yacht can be stabilized in the first operating state ("underway") by rotating the fin body 2 about the second shaft 7. The first shaft 8 is transverse to second shaft 7. The device according to the present invention can reduce the rolling motion of the yacht in the second operating state ("zero speed") by rotating the fin body 2 about the first shaft 8. FIG. 5A furthermore shows that the fin body 2 is connected to the hinge mechanism 5 in such a manner that it is rotatable about both the second shaft 7 and about the first shaft 8.

FIG. 5B diagrammatically shows a perspective view of a second embodiment of the hinge mechanism 5 according to the present invention which is connected to the fin body 2 from FIG. 5A. In this embodiment, the hinge mechanism 5 comprises a first shaft 8 which, by way of non-limiting example, comprises five shaft sections 9-12, 50. It will be clear to the person skilled in the art that it is also possible to use, for example, three shaft sections or, for example, six shaft sections. The five shaft sections 9-12, 50 from FIG. 5B can be moved jointly or separately from each other. On the one hand, it may be necessary to construct the first shaft 8 from five shaft sections 9-12, 50 if no single shaft section of the correct dimensions is available for the fin body 2 to be used and/or if a single shaft section cannot generate sufficient moment to produce the required lifting force in order to stabilize the yacht in the "zero speed" operating state. If a single shaft section is not able to keep the fin body 2 in its position due to the forces which act on the fin body 2 in the first operating state ("underway"), the first shaft 8 also has to be constructed from a plurality of shaft sections, for example five shaft sections 9-12, 50.

On the other hand, making up the first shaft 8 from five shaft sections 9-12, 50 provides redundancy in case a drive of a certain shaft section of the five fails. Consequently, the failure of one or more shaft sections of the five does not have to result in failing of the device according to the present invention, provided the remaining shaft sections can generate the required moment to produce the required lifting force to stabilize the yacht in the "zero speed" operating state and to keep the fin body 2 in its position in the "underway" operating state.

The use of five shaft sections 9-12, 50 or several groups of shaft sections furthermore makes it possible to move the fin body into a position with respect to the outer side of the construction by means of several steps. It is, for example, possible to set a first position of the fin body 2 with respect to the outer side 1 of the construction by means of a first group of shaft sections 9, 11, 12 and then to use a second group of shaft sections 10, 50 to rotate the fin body 2 in order to reduce the rolling motion of the construction in the second operating state ("zero speed").

If the five shaft sections 9-12, 50 can be moved independently from each other, it is possible to form several groups of shaft sections. In case a first 9, 11, 12 and a second group 10, 50 of shaft sections is formed, the first group 9, 11, 12 may, for example, be used to rotate the fin body 2 about the first shaft 8, while the second group 10, 50 is out of use. In case the first group 9, 11, 12 is no longer able to rotate the fin body 2 about the first shaft 8, the second group 10, 50 can be used. This provides redundancy and improves the operational reliability of the device according to the present invention.

FIG. 5C diagrammatically shows a perspective view of a third embodiment of the hinge mechanism 5 according to the present invention which is connected to a second embodiment of a fin body 2. This embodiment of the fin body 2 comprises two portions 51, 52 which are situated on either side of the first shaft 8 of the hinge mechanism 5. The first portion 51 can be positioned near or in close contact with the outer side of a construction via the second shaft 7 of the hinge mechanism 5. As the second portion 52 is rotatable about the first shaft 8, the second portion 52 of the fin body 2 can be moved into an inactive position, in which the second portion 52 of the fin body 2 runs parallel to the outer side of the construction. As a result thereof, the fin body 2 can be shortened in order to prevent damage to at least a part of the fin body 2 due to the fin body 2 becoming stuck in shallow water and/or due to manoeuvring in a harbour.

FIG. 5D diagrammatically shows a perspective view of a combination of the two hinge mechanisms 5 and a fin body 2 from FIGS. 5A and 5C, respectively. In this embodiment, the fin body 2, again by way of non-limiting example, comprises two portions 51, 52 in which both the first portion 51 and the second portion 52 can be moved from an active position into an inactive position by rotation about the first shaft 8. This embodiment has the advantage that a greater degree of flexibility is offered regarding shortening of the fin body 2 in order to prevent damage due to the latter becoming stuck in shallow water and/or due to manoeuvring in a harbour, as has already been mentioned above.

FIG. 5E diagrammatically shows a perspective view of a third embodiment of the fin body 2 according to the present invention which is connected to a hinge mechanism 5 from FIG. 5A. FIG. 5E shows that the fin body 2, by way of non-limiting example, comprises four sections 13-16 which are movably connected to each other by means of connecting elements 17-19. It will be clear to the person skilled in the art that it is also possible to use, for example, two sections or, for example, five sections. The fastening elements 17-19 extend in a direction parallel to the direction of the first shaft 8. By using several sections 13-16, it is possible to give the fin body 2 a shape which is such that the device according to the present invention can achieve an even better stabilization of the yacht in both the "underway" and the "zero speed" operating state.

FIG. 5F diagrammatically shows a perspective view of a fourth embodiment of the fin body 2 according to the present invention which is connected to a hinge mechanism 5 from FIG. 5A. FIG. 5F shows that the fin body 2, by way of non-limiting example, comprises three sections 20-22 which are movably connected to each other by means of connecting elements 23 and 24. It will be clear to the person skilled in the art that it is also possible to use, for example, two sections or, for example, four sections. The fastening elements 23 and 24 extend in a direction parallel to the direction of the second shaft 7. By using several sections 20-22, it is possible to give the fin body 2 a shape which is such that the device according to the present invention can achieve an even better stabilization of the yacht in both the "underway" and the "zero speed" operating state.

FIG. 5G diagrammatically shows a perspective view of a fifth embodiment of the fin body 2 according to the present invention which is connected to a hinge mechanism 5 from FIG. 5A. FIG. 5G shows that the fin body 2, by way of non-limiting example, comprises twelve sections 23-34 which are movably connected to each other, both by fastening elements 35-37 which extend in a direction parallel to the direction of the first shaft 8 and by fastening elements 38 and 39 which extend in a direction parallel to the direction of the second shaft 7. It will be clear to the person skilled in the art that it is also possible to use, for example 6 sections or, for example, 15 sections. By using the twelve sections 23-34 which are connected to each other so as to be movable in two directions, it is possible to modify the shape of the fin body still further. As a result thereof, the device according to the present invention can achieve an even better stabilization of the yacht in both the "underway" and the "zero speed" operating state.

FIG. 6 shows a third embodiment of the hinge mechanism 5 according to the present invention which is connected to a fin body 2 according to the first embodiment, as is shown, inter alia, in FIG. 5A. FIG. 6 shows that the hinge mechanism 5 comprises a ball hinge 40 which is configured to rotate the fin body 2 which is connected to the ball hinge 40 via a connecting element 41 which is, for example, a shaft. The ball hinge 40 is connected to the hull 1 of the yacht in such a way that the fin body 2 can be moved from the inactive position to the active position by rotating the ball hinge 40 at least about a first and a second rotation axis. By using the ball hinge 40, the fin body 2 of the device according to the present invention can be positioned in any desired position with respect to the hull 1 of the yacht. In this case, it is possible, for example, to position the fin body in the active position at an angle to the hull 1, as is the case, for example, with an aeroplane wing. This may perhaps result in an even better stabilization of the yacht in both the first ("underway") and the second ("zero speed") operating state.

The present invention is not limited to the embodiments described above as non-limiting examples. The scope of protection is determined by the meaning of the following claims, which allows for numerous modifications.

The invention claimed is:

1. Device for actively stabilizing a construction which, in use, floats in a liquid, wherein the construction, in a first operating state, moves through the liquid and, in a second operating state, is in a rest position in the liquid, wherein the device comprises at least one fin body (2) and a drive device which is connected to the fin body (2) and is configured to drive the fin body (2), wherein the device furthermore comprises a hinge mechanism (5) which is connected to the fin body (2) and is configured to position the fin body (2) with respect to an outer side (1) of the construction by rotating the fin body (2) about a first rotation axis (4) in such a manner that the fin body (2) can generate a lifting force which can stabilize the construction at least in the second operating state.

2. Device according to claim 1, wherein the hinge mechanism (5) comprises a first shaft (8) which is configured in such a way that the fin body (2), by rotation about the first shaft (8), can generate the lifting force which is required to stabilize the construction at least in the second operating state.

3. Device according to claim 2, wherein the first shaft (8) comprises a plurality of shaft sections (9-12, 50).

4. Device according to claim 3, wherein the plurality of shaft sections (9-12, 50) can be moved independently from each other.

5. Device according to claim 1, wherein the hinge mechanism (5) is also configured to rotate the fin body (2) about a second rotation axis (3) which is directed transverse to the first rotation axis (4).

6. Device according to claim 1, wherein the hinge mechanism (5) is configured to move the fin body (2), by means of a rotation about the first (4) and/or about the second (3) rotation axis, from an inactive position (P2, P3; P2-P5), in which at least one surface of the fin body (2) is situated substantially parallel to and near the outer side (1) of the construction, to an active position (P0), in which the fin body (2) is situated in such a manner with respect to the outer side (1) of the construction that the construction is adapted to be stabilized in the first and/or in the second operating state by rotating the fin body (2) about the first (4) and/or about the second (3) rotation axis.

7. Device according to claim 1, wherein the hinge mechanism (5) also comprises a second shaft (7) which is transverse to the first shaft (8), wherein the second shaft (8) furthermore extends at a predetermined angle to the outer side (1) of the construction and extends through the outer side (1) of the construction, wherein the fin body (2) is connected to the hinge mechanism (5) in such a way that it is rotatable about the first (8) and/or the second shaft (7).

8. Device according to claim 1, wherein the hinge mechanism (5) comprises a ball hinge (40) which is configured to rotate the fin body (2) about the first rotation axis (4) and/or about a second rotation axis (3).

9. Device according to claim 1, wherein the hinge mechanism (5) is configured to position the fin body (2) in a recess in the outer side (1) of the construction.

10. Device according to claim 1, wherein the drive device comprises a unit for rotating the fin body (2) about the first rotation axis (4), wherein the unit is accommodated substantially in the fin body (2).

11. Device according to claim 10, wherein the unit is connectable to a line from the construction, wherein the line is configured to supply power to the unit.

12. Device according to claim 1, wherein the device comprises a first and a second fin body (2) which fin bodies (2) are arranged on either side of the construction for stabilizing the construction in at least the second operating state by rotation about the first rotation axis (4).

13. Device according to claim 12, wherein the device is configured in such a way that each fin body (2) can be moved simultaneously about both the first rotation axis (4) and the second rotation axis (3).

14. Device according to claim 13, wherein the device is configured in such a manner that fin bodies (2) which are fitted on either side of the construction are movable asynchronously.

15. Device according to claim 1, wherein the fin body (2) comprises a plurality of sections (13-16; 20-22; 23-34) which are connected to each other by means of fastening elements (17-19; 20,21; 35-37, 38, 39) so as to be movable.

16. A vessel that floats at sea, wherein the vessel comprises a device according to claim 1.

* * * * *